United States Patent [19]

Karlsson et al.

[11] Patent Number: 4,719,708

[45] Date of Patent: Jan. 19, 1988

[54] ARRANGEMENT IN MATERIAL DRYING SYSTEMS

[75] Inventors: S. I. Karlsson; John B. Rudolfsson, both of Växjö ; Rolf K. Pettersson, Eneryda; Nicola Nenow, Växjö, all of Sweden

[73] Assignee: Fläkt AB, Nacka, Sweden

[21] Appl. No.: 815,221

[22] Filed: Dec. 31, 1985

[30] Foreign Application Priority Data

Jan. 16, 1985 [SE] Sweden ..... 8500197

[51] Int. Cl.[4] ..... F26B 13/20

[52] U.S. Cl. ..... 34/155; 34/156

[58] Field of Search ..... 34/155, 156, 232

[56] References Cited

U.S. PATENT DOCUMENTS

| | | | |
|---|---|---|---|
| 3,231,165 | 1/1966 | Wallin et al. | 226/97 |
| 4,394,950 | 7/1983 | Kramer | 34/156 |
| 4,425,719 | 1/1984 | Klein et al. | 34/156 |
| 4,505,053 | 3/1985 | Andersson et al. | 34/156 |
| 4,523,391 | 6/1985 | Smith et al. | 34/156 |

*Primary Examiner*—Albert J. Makay
*Assistant Examiner*—David W. Westphal
*Attorney, Agent, or Firm*—Burns, Doane, Swecker & Mathis

[57] ABSTRACT

The invention relates to an arrangement in drying sections intended for drying web material (2) which is arranged for movement through the drying section while supported by a plurality of air streams which impinge on the undersurface of the web and which extend parallel with, or substantially parallel with a plane allotted to the web, each of these air streams being given an exiting velocity and direction, via nozzle-like exit apertures (11, 11*a*) formed in a blow box (7), such as to maintain the web (2) in a suspended state above the blow box (7). Arranged in that end-part (8) of a blow box through which a flow of supply air (7*a*) is introduced thereinto is a means (20) operative in reducing and/or eliminating and/or over-compensating the influence of the velocity vector (7*a*') of the flow of supply air (7*a*) on the direction in which the air streams exit from the blow box through nozzle-like exit apertures (11,11*a*) formed therein and located adjacent the end-part (8) of the blow box. The interior of the blow box is divided into two chambers, a first chamber (71) intended for receiving the incoming flow of supply air (7*a*) and a second chamber (72) intended for receiving an air flow (7*b*,7*c*) separated from the incoming air flow, this separated air flow having a velocity vector which is considerably smaller than the velocity vector (7*a*') of the air flow entering the first chamber (71) and preferably having a direction opposite to the firstmentioned velocity vector.

31 Claims, 9 Drawing Figures

ARRANGEMENT IN MATERIAL DRYING SYSTEMS

TECHNICAL FIELD

The present invention relates to an arrangement in material drying systems or material drying sections of the kind in which the material, normally a paper web, is arranged for movement through the drying section while supported by a plurality of air streams impinging on the undersurface of the web of material and moving parallel with, or substantially parallel with a plane allotted to the web. Each of the air streams exits through a respective nozzle-like aperture, or exit orifice, provided in a blow box, at a velocity and in a direction such as to maintain the web in a stable suspended state above the upper surface of the blow box.

Preferably the invention relates to a drying section of the said kind in which clearly defined air streams are created along the path travelled by the web through the section, and in which these air streams are generated with the aid of positive pressure created in one or more blow boxes arranged transversally to the web travel, these boxes presenting upwardly facing nozzle-like apertures, e.g. narrow slits, such as to create air streams at locations adjacent the apertures.

Although the following description is drafted solely with refernce to air and air streams, it will be understood that other gaseous media can be used.

It will also be understood that by air-exiting direction as used here is meant the average value of the divergent and/or convergent air-exit directions in an air stream. Similarly, by the velocity vector of an air stream is meant the mean value of all velocity vectors presented in an air stream.

BACKGROUND PRIOR ART

There is known to the art a number of paper-web drying arrangements of the aforedescribed principal construction.

The present invention is based on drying sections or drying arrangements of the kind in which a plurality of blow boxes are located transversally of the longitudinal direction of the paper web and operative to hold the web suspended in a stable position above the boxes. To this end each box has a planar, or substantially planar upper surface having formed therein air-exit orifices, each of which is oriented to direct a stream of air parallel to the web of paper, or some other material.

An example of such constructions is described and illustrated in U.S. patent specification No. 3,231,165.

It is also known to provide an arrangement of top and bottom blow boxes, in order to achieve an improved drying effect, therewith enabling a shorter drying-path through the dryer to be accepted, which in turn enables the coated or lined structural surface of the dryer to be reduced, in the case of new constructions.

An example of a prior-art dryer of this kind is described and illustrated in South African Patent Specification No. 82-7124, this known dryer incorporating a plurality of upper and lower blow boxes which are substantially parallel and at right angles to the direction of web travel. The lower blow boxes have provided in the surfaces thereof facing the web a plurality of air-exit or blow orifices, each of which is arranged to project a stream of air in a direction substantially parallel with the plane of the web, in a manner to support the web.

The speed at which the air-streams exit through the orifices and the configuration of said orifices are such as to enable respective air streams to sustain the web in a given position of suspension above the blow boxes. If the web has a sufficiently high surface weight (in excess of 400 g/m$^2$), the upper blow boxes can be located on the opposite side of the web, and are normally provided with blow orifices adapted to blow air in a direction substantially at right angles to the plane of the web.

In dryers of the kind described and illustrated in the U.S. patent specification, it has been observed in practice that not all the air streams issuing from the upper blow boxes are directed at right angles to the plane of the web, but that some air streams deviate from this direction and obtain a velocity component which is directed in the longitudinal direction of the blow boxes, parallel with the flow direction of the incoming airflow, entering said box.

In the case of air-exit orifices formed in the manner described and illustrated in the aforesaid U.S. patent specification, where the orifices are in direct communication with an air-supply chamber or passageway, it has been found that the exiting air stream has a helical configuration, where the major directional axis has a directional component parallel with the velocity vector of the stream of supply-air. The directional component of downstream air-flows, seen in the direction of air flow, becomes smaller and smaller, and consequently mutually adjacent air streams will be directed slightly towards one another.

In dryers of the kind described and illustrated in the aforesaid South African patent specification, it has also been observed with regard to the upper blow boxes, where the air-stream exit orifices are in direct communication with an air-supply chamber or passageway, that the air streams adjacent the end part of the upper blow boxes exit in a direction having a progressively decreasing directional component which is parallel with the velocity vector of the air-supply flows, and hence mutually adjacent air streams are directed slightly towards one another.

These converging air streams, irrespective of whether they are generated by the lower or upper blow boxes, result in irregular increases and decreases in pressure in the region of the surfaces of the blow boxes and create air transportation along said surfaces and transversally of the direction of web travel. It is obvious that web flutter will be greater in the presence of upper and lower airstreams having directional components parallel with the velocity vector of the air-supply stream, than in the presence of solely lower air streams. These two occurrences, pressure variations and air transportation along the boxes, impair stabilization of the web effected through the air streams projected thereagainst, i.e. impair the effect of the forces which strive to hold the web at a constant distance from the blow boxes. The aforesaid occurrences of pressure differences and in transportation also generate forces which act laterally on the web, thereby causing web movement in a lateral direction.

The oblique path followed by the air streams from the upper blow boxes, inter alia due to directional components which lie parallel with the velocity vector of the incoming stream of supply air, are liable to result in a negative, amplifying effect, when local pressure increases on the upper surface of the web occur simultaneously with pressure decreases on the undersurface thereof.

In summary, it can be said that the convergent air streams result in an irregular pressure distribution across the top and bottom surfaces of the web, and that there is obtained a resultant air flow between blow boxes and web which is directed transversally to the direction of web travel.

DISCLOSURE OF THE PRESENT INVENTION

TECHNICAL PROBLEMS

When viewing the present state of the art as expressed above, it will be seen that a technical problem resides in the provision of means whereby the influence of the velocity vector of the supply air stream on the exiting direction or directions of the exiting air streams can be reduced and/or eliminated and/or over-compensated, at least in the end part at which the flow of supply air enters the blow box.

A further technical problem in the aforesaid respect is one of providing means which will ensure that the major directional components of mutually adjacent air streams are parallel with one another, or are slightly divergent.

Another technical problem is one of enabling existing blow boxes to be modified in a simple fashion so as to modify the air streams exiting therefrom, and so as to import to said streams a directional sense and a structure which will enable thinner webs to be dried than was hitherto possible.

A further technical problem is one of providing an insert unit constructed for such purposes.

A further technical problem lies in the realization that the aforesaid technical problems can be satisfactorily overcome in known blow-boxes, by providing such boxes with especially designed exit orifices.

It will also be seen from a study of the prior art as expressed above that another technical problem resides in the ability to take measures which will eliminate, or in all events substantially reduce the effect of the unidirectional velocity components obtained by air streams exiting from a blow box, due to the direction of the air-supply stream in said box.

It will also be seen that a further technical problem in this particular art resides in the provision of simple means which will enable thin material webs, having a weight of about 40 g/m$^2$, to be dried effectively in a dryer in which adjacent blow boxes are supplied in sections from one and the same direction, while holding the webs suspended in a satisfactory manner, i.e. while maintaining good web fixation.

One technical problem prevailing in dryers dimensioned and adapted for treating extremely thick material webs, such as paper pulp, is one of providing means with which the dryer can be readily modified for use when drying thin paper webs, or vice versa, while maintaining satisfactory web fixation.

Still another technical problem is one of providing means by which the flow conditions of the air streams exiting from respective air boxes can be improved and the directions of said air streams changed, such as to create smooth flow conditions under which the web is subjected to a slight stretching force in a direction transversally of the direction of web travel, by the air streams impinging on said web.

It will be seen that a technical problem also resides in the provision of means which enables immediately adjacent blow boxes to be supplied with a stream of supply air from one and the same side, without causing lateral displacement of the web relative to the direction of web travel.

In the case of drying sections, or dryers, adapted for drying thin paper webs, a further technical problem resides in permitting the webs to be subjected to air streams impinging from both sides, while maintaining a stable, web-suspended position in the proximity of the lower blow-boxes, with blow-boxes being thus arranged both beneath and above the web.

It will also be seen that another technical problem is one of providing simple means which can be readily incorporated in the blow boxes of existing dryers so as to improve web-fixation (as hereinbefore defined), reduce tendencies towards lateral displacement of the web and at the same time, create outwardly acting forces on the web margins, to hold the web stretched.

Another technical problem is one of providing a device, having a small longitudinal extension in the blow box, which need only be applied to one end part of the blow box while nevertheless compensating for any tendency of the web to lateral displacement caused by the flow of supply air in the blow box.

A further technical problem is one of providing a dryer, or drying section, which will afford good web fixation in the case of webs of low surface weight, where the air supply flow is generated by a fan, or an array of fans, and where said fan or said array can be placed on one side of the drying section or dryer and adapted to serve one section thereof, while a further fan or fan array can be arranged on the other side of the dryer for supplying a stream of input air to an adjacent section, and where it is possible to connect all the end parts of the blow boxes in the section to said respective fans, or blowers.

A further technical problem resides in the provision of simple means and devices in a dryer according to the aforesaid U.S. patent specification, which will enable the dryer, or drying section to be given a shorter length.

In addition hereto, it will be perceived that in the case of drying sections which incorporate upper and lower blow boxes a further technical problem resides in the provision of means by which the air streams exiting from the upper blow boxes are directed at right angles to the direction of web travel, or have a component which is oppositely directed to the direction of the supply air entering the respective blow box.

With regard to the present state of the art as expressed above, it will also be seen that a further technical problem is one of providing simple means with which, in respect of upper blow boxes, the effect of the velocity vector of the incoming air on the exiting direction of the outgoing air streams can be reduced and/or eliminated, at least in the end parts of the blow boxes at which the incoming air enters.

It will also be seen that a further technical problem is one of ensuring that the directional components or directions of adjacent air streams leaving the upper blow box are parallel with one another, or slightly divergent.

In the case of existing upper blow boxes, a further technical problem resides in the provision of means which will enable the air streams to be changed and given a directional sense and a structure such as to enable thinner webs to be dried than was previously possible, while maintaining good web-fixation, i.e. a web suspended at a given distance above the lower blow boxes.

It will further be seen that advantage is afforded when providing a simple insert unit which can be used in conjunction with the upper blow box, for aforesaid purpose.

In those cases when the width of the web progressively decreases during a drying stage, another qualified technical problem resides in the provision of simple means effective to eliminate the prior drawback of the edge portions of the web being lifted by the air streams exiting through orifices located in the end parts of the blow box, and particularly orifices located at the input end of the blow box, especially when the air streams are slanted towards said edge portions.

A further technical problem in respect of existing drying sections or dryers equipped solely with lower blow boxes, resides in the provision of simple means which enable such drying sections to be used to dry materials, paper webs, of lower surface weight than was previously possible.

In the case of existing drying sections or dryers which incorporate solely lower blow boxes, a technical problem resides in the provision of simple ways and means which enable a drying process to be effected more efficiently, by further incorporating upper blow boxes, even to a limited extent, and therewith create conditions which will afford one or more of the following advantages: an increase in web speed through the dryer; effective treatment of webs of heavier surface weight than normal; reduction in the temperature of the dryer; and an increase in the extent to which the material is dried in the dryer, or drying section.

In the case of existing dryers provided with both upper and lower blow boxes, a technical problem resides in the provision of simple ways and means which will enable light-weight materials, light-weight paper webs, to be dried effectively without inducing flutter in the webs and while holding the web stable during its passage through the dryer.

SOLUTION

The present invention relates to an arrangement in material-web drying sections of the kind in which the web is moved through the drying section while supported by a plurality of air streams impinging on the undersurface of the web and being oriented parallel with, or substantially parallel with a plane allotted to the web. Each of the air streams issues from a respective blow box having located therein exit orifices or apertures which have a form and construction such that the exiting air streams are given a speed and direction which will hold the web in a suspended state. The blow box, or boxes, generating respective air stream extends, or extend, transversally to the whole of the web and are oriented transversally to the direction of web travel.

In accordance with the invention the supply-air input end of at least one blow box is provided with means operative in reducing and/or eliminating, and/or overcompensating the influence of the velocity vector of said input flow of supply air on the exiting direction of those air streams which exit through the nozzle orifices located in the region of said end part of the blow box.

Preferably all blow boxes comprising a blow-box section or group are formed or provided with such means.

In accordance with one advantageous embodiment of the invention the aforesaid means is effective in dividing the interior of the blow box into two chambers, of which a first chamber is intended to receive the incoming flow of supply air, and a second chamber which is intended to receive an air stream separated from the supply-air flow, this separated air stream having a velocity vector which is considerably smaller than the velocity vector of the input air flow to the first chamber, and preferably directed oppositely thereto.

In accordance with the concept of the invention, air-stream exit nozzles formed in the blow box are in open communication with the second chamber.

In the case of drying sections in which the blow boxes have a substantially planar upper surface which extends parallel with the web of material to be dried, there is suitably provided in the surface of respective boxes a plurality of exit nozzles, and the aforesaid means is adapted for solely a few exit nozzles located in the proximity of said end part of the blow box. The nozzle exit orifices are positioned at a distance from the edge of the upper surface of the blow box and each alternate exit orifice is arranged to direct an air stream in the direction of web travel, whereas each other exit orifice is arranged to direct the exiting air stream against said direction of web travel.

Advantageously the air-stream exit nozzles are arranged along and in, or adjacent to, the centre line of the upper surface of a respective blow box, and the nozzle orifice has a configuration which coincides with or conforms to part of a circle, for example a segment of a circle, but preferably smaller than a semi-circle. Located in the aforesaid upper surface, adjacent respective nozzle orifices is a depression, having a depth which decreases in a direction away from the nozzle orifices.

In accordance with a further embodiment of the invention, the aforesaid means is positioned in that end part of the blow box at which the supply air enters said box. The means, in connection with said end part of the blow box, is arranged to steer air streams present in the region thereof in a manner such that each of such air stream obtains a well-defined directional component which is oriented parallel with, or substantially parallel with the web of material being dried and also parallel with, or slightly divergent relative to a centre line allotted to the material, i.e. the direction of material travel.

It should be possible to form the aforesaid means so as to generate a directional component which extends in the direction opposite to the input direction of the incoming flow of supply air.

In accordance with a further development of the invention, two or more juxtaposed blow boxes provided with air-stream exit nozzles are supplied with air through similarly located box end-parts.

In those drying section constructions in which blow boxes are provided above the web of material and have nozzles which face towards said web, such upper blow boxes are also suitably provided with the aforesaid means.

In accordance with one advantageous embodiment of the invention the aforesaid means has the form of a device effective to change the direction of air flow in a blow box, said device having the form of a plate provided with a number of slots. Each slot has a first edge portion which faces against the air flow, and a second edge portion which extends in the direction of input air flow and is located adjacent the first edge portion of said slot.

The aforesaid means is preferably arranged to guide the air flow entering said end-part of the blow box outwardly of the centre line of the material web being dried, the extent of this deflection being less than 25°, preferably about 10°. The aforesaid means, or plate, shall have a length smaller than half the longitudinal extension of the blow box, preferably less than one quarter of said longitudinal extension.

In accordance with the invention one or more upper blow boxes has provided in the end-part thereof at which the flow of supply air enters said box a device which, in conjunction with said end-part is operative in guiding air streams generated in said end-part in a manner such that each of said air streams obtains a well-defined direction at right angles to the web of material being dried, or even directed slightly towards said end-part.

With respect to the upper blow boxes, there is provided in that end-part of at least one blow box at which the flow of supply air enters said box a means, or device, which is effective in reducing and/or eliminating and/or over-compensating the effect of the velocity vector of the incoming air flow on the direction in which the air streams exit through the nozzle orifices located in the region of said end-part of said blow box.

In accordance with one suitable embodiment of the invention all upper blow boxes forming a section or group are provided with the aforesaid means.

Conveniently, the interior of each upper blow box is divided in the region of said end-part into two chambers, a first chamber intended to receive the incoming supply air and a second chamber intended to receive an air flow separated from the incoming air flow, where the separated air flow has a velocity vector which is considerably smaller than the velocity vector of the air flow entering the first chamber, and preferably directed oppositely thereto. The nozzle orifices through which the air streams exit from the blow box are in direct communication with the second chamber.

Each of the upper blow boxes is preferably provided with a planar undersurface which extends parallel with the web of material being dried and which has a plurality of air-stream exit nozzles located therein, said blow box being provided with the aforesaid means which is adapted for solely a number of exit nozzles adjacent said end-part of the blow box.

In accordance with a further embodiment of the invention two or more mutually adjacent upper blow boxes provided with air-stream exit nozzles directed towards the paper web are supplied with air from similarly located end-parts.

In accordance with a further advantageous embodiment of the invention the aforesaid means is of an elongated configuration, with one end of the means being located in or adjacent that end-part of the blow box at which the input air enters said box and extending through the blow box through a distance corresponding approximately to one tenth of the total longitudinal extension of said box.

In respect of the upper blow box, the aforesaid means comprises a device which changes the direction of the air flow in the blow box. Such means may comprise a disc or plate provided with a number of slots each presenting a first edge part which faces the air flow and a second edge part which lies adjacent said first edge part and which extends into the air flow.

In respect of the upper blow box, the aforesaid means shall be arranged to deflect the direction of air flow outwardly from the centre line of the material web, this deflection being less than 25°, preferably about 10°.

ADVANTAGES

Those advantages primarily afforded by an arrangement according to the present invention reside in the ability to pass the web of material through the drying section while maintaining the web in a stable, suspended position in the absence of laterally acting forces. A further advantage resides in the ability of supplying air to similarly located end-parts of mutually adjacent blow boxes from one and the same fan arrangement. The geometry of the requisite passageways is thus simpler and less expensive than the passageway geometry of known drying sections of this kind. Furthermore, the pressure drop is lower, enabling savings in energy to be made. A further important advantage afforded by the arrangement is that low surface-weight material webs can be passed stably through the drying section with air directed against both sides of the web, therewith enabling the volume of the drying section to be greatly reduced.

The main characteristic features of an arrangement according to the invention are set forth in the characterizing clause of the following claim 1.

DESCRIPTION OF THE DRAWINGS

A preferred embodiment having features characteristic of the invention will now be described in more detail with reference to the accompanying drawings, in which.

DESCRIPTION OF PREFERRED EMBODIMENTS

Figure 1:
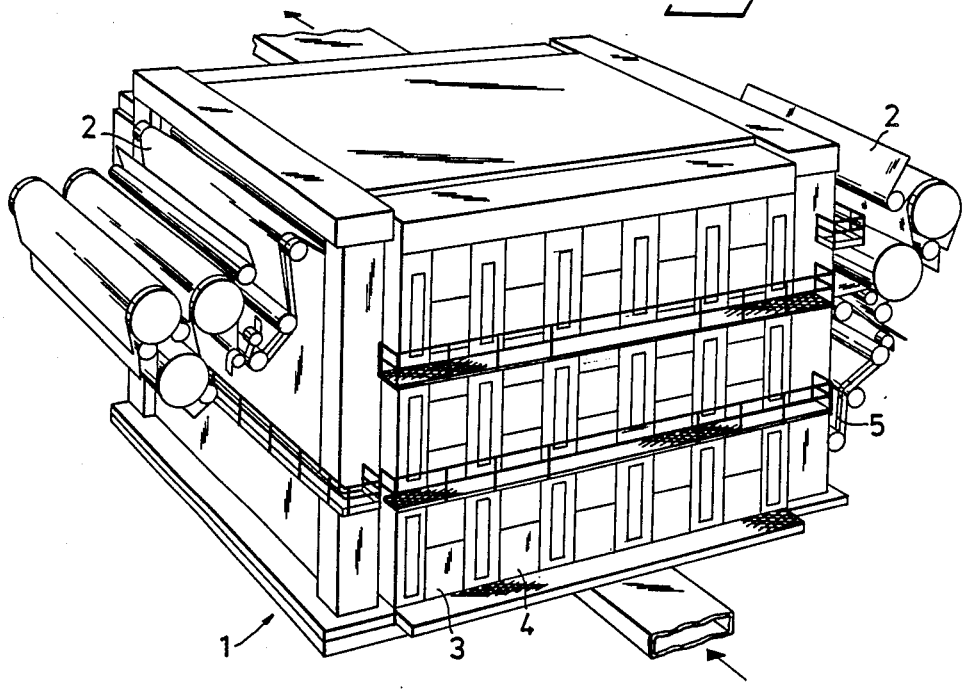
FIG. 1 is a perspective view of a prior art drying section.

Thus, FIG. 1 is a perspective view of a drying section 1 in which the material 2 to be dried, e.g. a paper web, is moved through the drying section while supported by a plurality of air streams generated by a plurality of fan units 3,4, in a manner to hold the material web 2 suspended in a stable state throughout the entire drying section 1, the web leaving the drying section as a dried web as illustrated by the reference 5 to the right of the figure.

Figure 2:
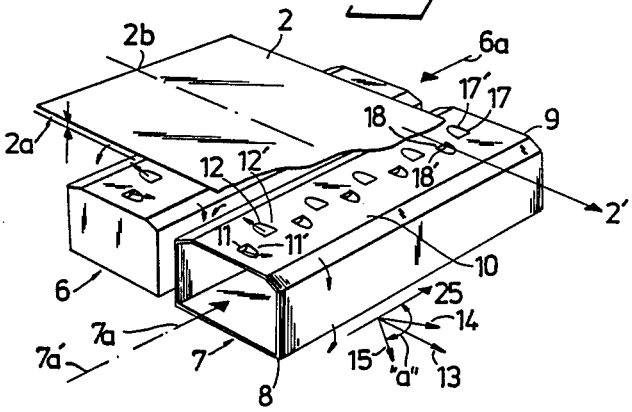
FIG. 2 illustrates in perspective two lower blow boxes extending parallel with one another transversally to the direction of web travel, these blow boxes being intended to generate air streams having an exiting velocity and direction suitable for maintaining the web suspended above the boxes.

FIG. 2 illustrates in perspective two mutually adjacent lower blow boxes 6,7 which are used in the drying section illustrated in FIG. 1 and of which the blowing box 6 is supplied with an air flow 6*a* from one side of the box and the other blow box 7 is supplied with an air flow 7*a* from the other side.

The blow boxes illustrated in FIG. 2 are instrumental in supporting the material web 2 during its passage through the drying section 1 through the agency of a plurality of air streams 11' and 12' which impinge on the undersurface of the web 2 in a direction which is parallel with, or substantially parallel with a plane 2*a* allotted to the web 2, and each of which air streams exits from respective blow boxes at a speed and in a direction such as to maintain the web 2 stably suspended above the blow boxes. The figure also illustrates the presence of air streams along the direction of web travel 2', these air streams being generated from elongated blow boxes 6,7 extending across the whole of the web 2.

Since the blow boxes illustrated in FIG. 2 are identical to one another, the following description will be made solely with reference to the blow box 7.

Arranged in uniform spaced relationship along the whole of the upper surface 10 of the blow box 7 are exit orifices, referred to hereinafter as nozzle-like apertures, of which two are referenced 11,12 adjacent the edge part 8 of the blow box. Each of the nozzle-like apertures 11,12 generate a respective air stream 11' and 12' which move in opposite directions and which are substantially parallel with the direction of web travel 2', i.e. to the centre line 2*b* of the web. Entering the blow box 7 at one end thereof, arrowed in the figure, is an air flow 7*a* having a major direction or a velocity vector 7*a*. This means that the air streams 11' and 12' exiting through the respective nozzle-like apertures 11 and 12 are not exactly parallel to the direction of web travel 2' or the centre line 2*b*, but obtain a directional component extending towards said centre line. This applies to the end-part 8 of the blow box 7. The magnitude of this directional component is dependent on the velocity of the incoming air flow 7*a* adjacent respective apertures.

This directional component thus diminishes from the end-part 8 towards the end-part 9 of the blow box 7, and can, in practice, be considered to be "zero" in the vicinity of the aperture 17 and the air stream 17' generated by said aperture. The sum of these directional components, for all air streams along the blow box 7. provides a resultant which extends parallel to the incoming air flow 7*a* and influences the web 2 with a force which tends to displace the web towards the end-part 9.

This displacement force, which is of small magnitude, can be assumed to be amplified by the rotating, turbulent form of the air streams 11' and 12', resulting in local pressure increases and pressure decreases and therewith fluttering of the paper web 2.

Figure 2A:
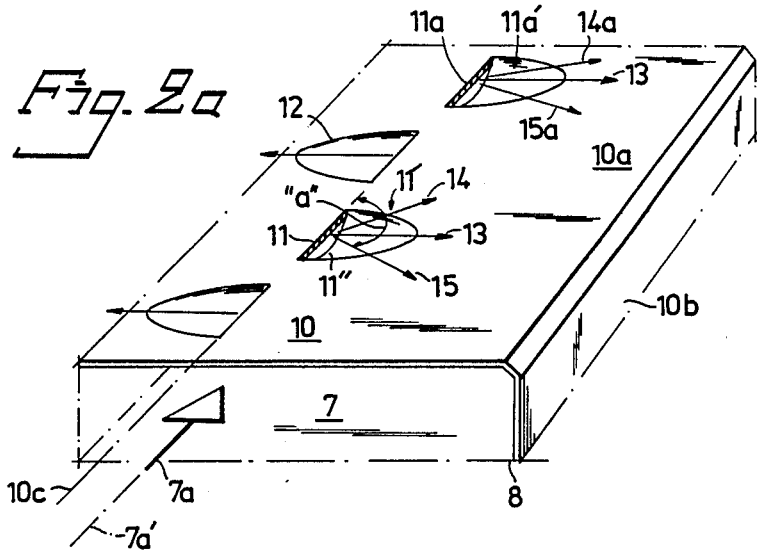
FIG. 2*a* is an enlarged view of one end part of a blow box shown in FIG. 2, and illustrates the directions in which the air streams exit from the blow box.

The arrow 13 in FIGS. 2 and 2*a* illustrate, in connection with the air stream 11, a direction which is parallel with the centre line 2*b* of the web, while an arrow 14 indicates, although slightly exaggerated, the true direction taken by the air stream 11' as it leaves the nozzle-like aperture 11, when said aperture is in direct communication with the interior of the blow box.

When comparing the direction 14 taken by the air stream 11' and the direction taken by the adjacent air stream 11*a'*, it will be seen that these air streams converge slightly on one another, this being the case in the previously known arrangement according to the aforementioned U.S. patent specification.

It can also be assumed in the case of the known arrangement that the velocity vector 7*a'* of the incoming air flow results in a helical air stream 11' and 11*a'* respectively, therewith giving rise to the aforesaid pressure increases and pressure decreases along a surface referenced 10*a* in FIG. 2*a*.

The sum of the directional components and the helical air streams co-act to create forces which are liable to cause web flutter and also to displace the web laterally.

As illustrated in FIG. 2, this tendency towards lateral displacement of the web can be compensated by supplying air 6*a* to an adjacent blow box 6 from the end of said blow box opposite to the end 8 of the blow box 7. This expedient, however, will not solve the problem of web flutter caused by air streams having a pronounced helical form.

Since the directional component 14 is greater at the end-part 8 of the blow box 7 at which the flow of supply air 7*a* enters said box than at the end-part 9 of the blow box, the same applying to the blow box 6, the edge portions of the web 2 will be subjected to mutually spaced forces directed towards one another. These forces will create problems, particularly in the case of thin webs 2, owing to the fact that said forces in combination with vortices in the air streams contribute to web flutter and because it is impossible to maintain the desired stability of web suspension above the blow boxes.

According to the present invention there is provided an arrangement in drying sections of the kind in which the material to be dried, in the form of a web 2, is arranged for movement through the drying section while supported by a plurality of air streams 11',12',11*a'* impinging on the undersurface of the web and extending parallel, or substantially parallel with a plane allotted to said web, each of said air streams being given an exiting velocity and direction, through a blow box 7 provided with airstream nozzle-like apertures 11,11*a*, such as to maintain the web in a suspended state. Provided in the end-part 8 of at least one blow box 7, i.e. the end-part at which the flow of supply air 7*a* enters the blow box, is a means or device operative in reducing and/or eliminating and/or over-compensating the effect of the velocity vector 7*a'* of the incoming air flow on the direction 14, 14*a* of the air streams 11' and 11*a'* exiting through the nozzle-like apertures located in the region of said end-part 8 of the blow box 7.

In accordance with one advantageous development of the invention, all blow boxes comprising a group of blow boxes are advantageously provided with such air-flow controlling means.

Figure 3:
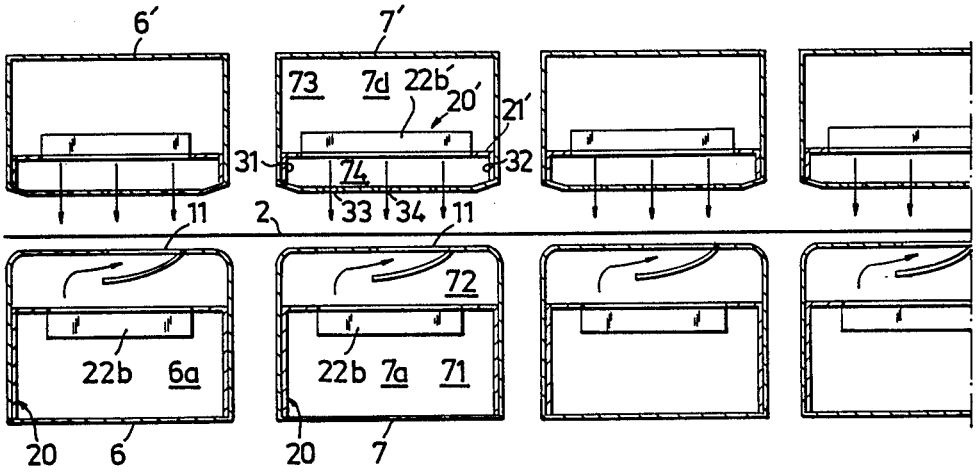
FIG. 3 is a sectional view of a plurality of upper and lower blow boxes comprising a group or section, each of the blow boxes being provided with the aforesaid means according to the invention.

As illustrated in FIG. 3, the interior of the blow box 7 adjacent the end-part 8, is divided into two chambers 71 and 72, of which a first chamber 71 is intended to receive the incoming air flow 7*a*, and a second chamber 72 is intended to receive an air flow 7*b* separated from the incoming air flow 7*a*, this separated air flow 7*b*, when present in the chamber 72 as an air flow 7*c* (cf. FIG. 5), presenting a velocity vector which is considerably smaller than the velocity vector 7*a'* of the incoming air flow 7*a* in the first chamber 71, and preferably counter-directed to said velocity vector 7*a'*.

Figure 5:
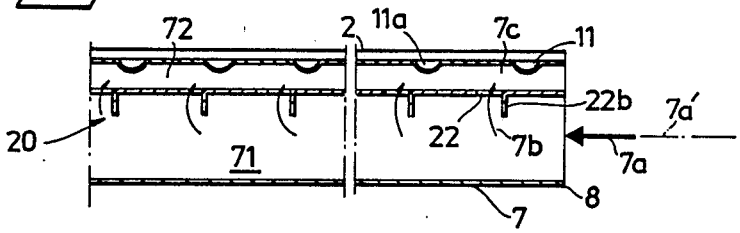
FIG. 5 is a sectional side view of the means illustrated in FIG. 4 inserted in a lower blow box according to FIG. 2, this figure illustrating more clearly the flow of supply air into the blow box and the distribution of the air in the two chambers formed in said box.

It will also be seen from FIG. 3, and also from FIG. 5, that the nozzle-like exit apertures 11, 11*a* provided in the blow box 7 are in open communication with the second chamber 72.

It will be seen from FIG. 2 that the blow box 7 has a substantially planar upper surface 10, which extends parallel with the material web 2 and which is provided with a number of nozzle-like exit apertures 11,11*a* which face in one direction and a number of nozzle-like exit apertures 12 which face in the opposite direction, and in which the aforesaid air-flow control means is adapted to serve solely a limited number of apertures adjacent said end-part 8 of the blow box.

As will be seen from FIG. 2*a*, the nozzle-like apertures 11,11*a* and 12 through whch the air streams exit are located at a distance from the edge part 10*b* of the upper surface 10 of the blow box, and each alternate aperture provides an air stream which is directed in the direction of web travel 2', while each other aperture provides an air stream which is directed against the direction of web travel. The nozzle-like apertures are arranged along and on or adjacent to a centre line 10*c* of the upper surface 10.

The nozzle-like apertures have a configuration corresponding to or conforming with a segment of a circle, preferably smaller than a semi-circle, and arranged in the upper surface 10, adjacent respective apertures 11, is a depression 11" having a depth which decreases in a direction away from the nozzle-like aperture.

Figure 4:
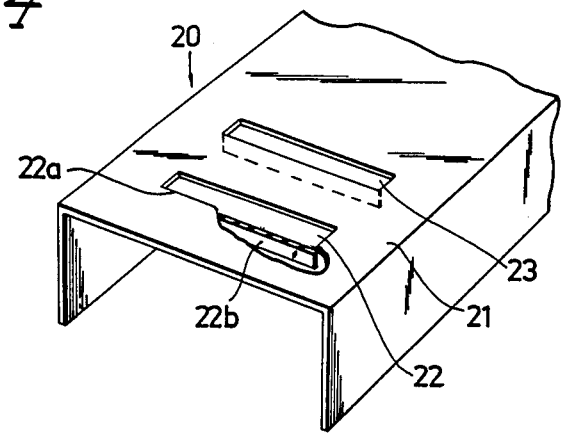
FIG. 4 is a perspective view of the aforesaid means intended for a lower blow box.

Thus, in accordance with the invention, there is inserted in the end-part 8 at which the air flow 7*a* enters the lower blow box 7 an air-flow control means 20, shown in more detail in perspective in FIG. 4, which in conjunction with said end-part controls the air streams 11', 11*a*', 12' created therein so that said air streams obtain a well-defined directional component 15, 15*a* which is oriented substantially parallel with the material web 2 and divergent from the direction of web travel 2'. As illustrated in FIG. 3, it is possible in this way to feed a flow of supply air into similarly located end-parts of two or more mutually adjacent blow boxes 6,7 having nozzle-like exit apertures 11 provided adjacent respective end-parts of the blow boxes.

The control means 20 comprises a device which is operative in changing the direction of the incoming air flow 7*a* within the blow box 7.

The control means 20 in respect of said blow box comprises a plate 21 having slots 22,23 arranged therein. Each of the slots has a first edge part 22*a* which faces the direction of the air flow, and a second edge portion 22*b* which extends into the air flow and which is located adjacent the first edge portion 22*a*.

Arranged in that end-part of at least one lower blow box at which the flow of supply air enters said blow box is a means operative in reducing and/or eliminating the effect of the velocity vector of the incoming flow of supply air on the direction of the exiting air streams through the nozzle-like apertures located in the region of said end-part of the blow box.

Preferably, all the lower blow boxes forming a group of such boxes are provided with such means.

Additional upper blow boxes 7', 6' having nozzle-like apertures facing the material web 2 have also been arranged above said web.

Inserted in the inflow end-part of one or more upper blow boxes is a control means 20' which, in conjunction with said end-part, is arranged to guide the air streams in a manner such that each air stream has a well-defined direction oriented at right angles to the web of material 2. The control means 20' of the upper blow boxes also comprises a device operative in changing the direction of the air flow 7*d* in the blow box 7'. As will be seen more clearly from FIG. 8, the control means 20' has the form of a disc or plate 21' provided with a number of slots 22', each slot having a first edge portion which faces the direction of edge flow and a second edge portion 22*b*' which extends into the flow of incoming supply air 7*d* and which is located adjacent said first edge portion.

The aforesaid two control means 20 and 20' are arranged to deflect the air flow entering the aforesaid end-part of a respective blow box outwardly through an angle of less than 25°, preferably about 10°, in relation to the centre line of the material web.

The plate 21' of the upper blow box has two support legs 31,32 and comprises a U-shaped rail which can be inserted into the blow box 7' and which extends only a short distance along the blow box.

The interior of each upper blow box is divided into two chambers, a first chamber 73 intended for receiving a flow of incoming supply air, and a second chamber 74 intended for receiving an air flow separated from the incoming air flow, the separated air flow having a velocity vector which is considerably smaller than the velocity vector of the air flow entering the first chamber 73, and preferably having a direction opposite thereto.

The nozzle-like apertures 33,34 formed in the blow box are in direct communication with the second chamber 74.

Each blow box has a planar undersurface which extends parallel with the material web 2 and which has formed therein a plurality of nozzle-like apertures 35,36 and 37 through which respective air streams exit. The blow box is also provided with air-flow control means adapted to serve solely a number of apertures located adjacent the end-part 75 of the blow box at which the supply air enters therein. Two or more mutually adjacent upper blow boxes provided with air-stream exit apertures are supplied with air through similarly located end-parts.

FIG. 5 illustrates how the flow of incoming air 7*a* passes into a lower blow box 7, but where, for example, the edge portion 22*b* causes a change in the incoming air flow 7*a* so that a part 7*b* thereof passes around said edge portion 22*b* and passes into the chamber 72 and from there through the slots 11 and 11*a*, while imparting to the exiting air streams 11', 11*a*' a direction which conforms to the arrows 15 and 15*a* respectively shown in FIGS. 2 and 2*a*.

Figure 6:
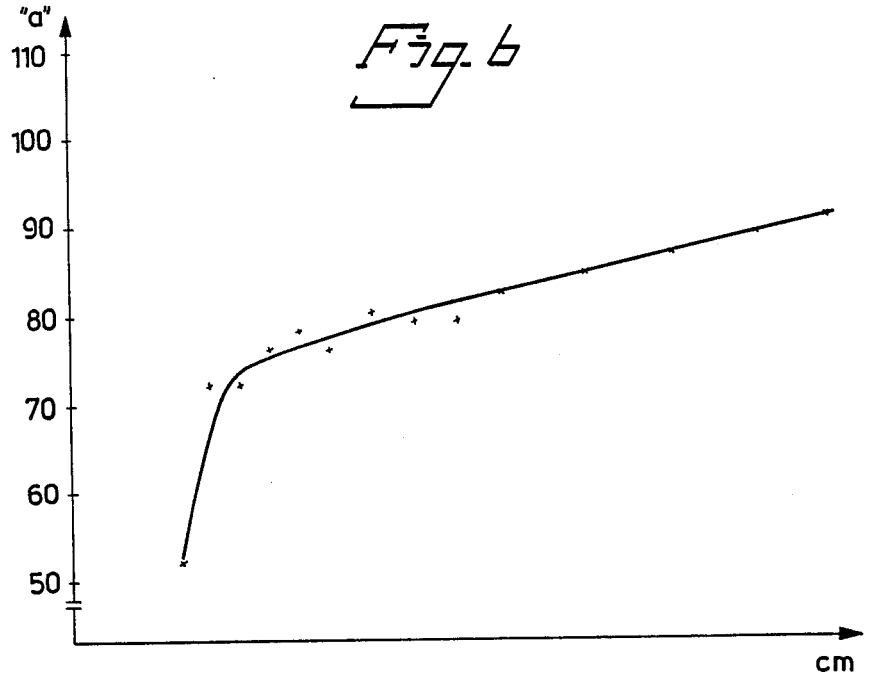
FIG. 6 is a diagram illustrating the direction of the air streams along the blow box in the absence of means according to the invention.

FIG. 6 is a diagram illustrating the directions taken by the exiting air stream 11' and the following air streams 11*a*' in relation to a direction 25 shown in FIG. 2, as a function of the distance from the end-part 8 of a respective blow box which has not been provided with control means in accordance with the invention. The shown angle "a" is 90° to a direction conforming with the arrow 13.

It will thus be seen from FIG. 6 that within a distance from the end-part 8 of the blow box 7 the exiting air streams 14 and 14*a* leave through sequential apertures within an angle "a" which is smaller than 90°, thereby creating the aforesaid conditions which tend to laterally displace the web 2, to the right as seen in FIG. 2, and cause the web to flutter and become unstable.

Figure 7:
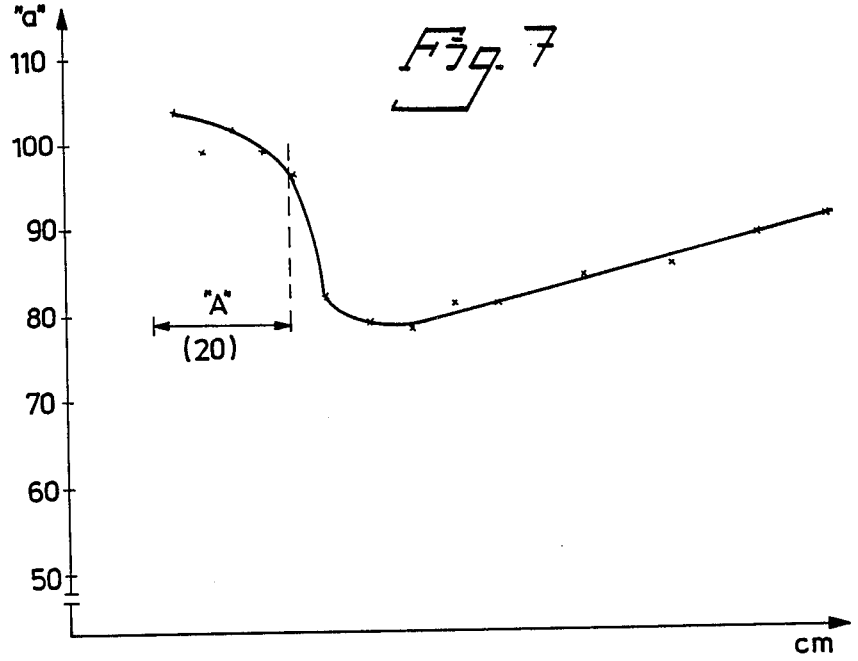
FIG. 7 is a diagram illustrating the direction of the air streams along the blow box when a means according to the invention and having the form illustrated in FIG. 1 is incorporated in one end-part of the blow box.

FIG. 7 is a diagram obtained in respect of a blow box 7 having provided in the end-part 8 thereof, in accordance with the invention, the control means 20 illustrated in FIG. 4, said control means being inserted to a length corresponding to the distance "A" shown in FIG. 7, so that when leaving the exit apertures the air streams 15 and 15*a* are contained within an angle "a" which is greater than 90°, thereby creating conditions in which the edge portions of the web 2 are stretched away from one another, and in which the exiting air streams obtain a smoother flow pattern such as to enable a thin paper material to be passed through the drying section without fluttering and while being sustained in a stable suspended state. It will clear herefrom that the air streams 15, 15*a* exiting from the blow box are imparted a direction conforming to the direction of the arrow 15 in FIG. 2 and are operative in maintaining the web 2, for example a web of low surface weight, in a stable fixed path centrally of the drying section.

The provision of two chambers (71,72) provides conditions in which the air present in the second chamber moves slowly in a direction along the blow box, while ensuring a smooth stream of air through the exit apertures 11,11*a*.

In the aforedescribed embodiment the lower blow box has been provided with control means 20 for changing the direction of the air stream 11' so that a directional component thereof is directed towards the flow direction 7*a* of the supply air entering the blow box.

Each of the control means (20 or 20') used in conjunction with the lower blow box and the upper blow box, and the exit apertures formed therein, shall have a length ("A") smaller than half the longitudinal extension of the blow box, preferably smaller than a quarter of said longitudinal extension.

The control means 20 and 20' are arranged in respective blow boxes with one end part of said means located in or adjacent to the end-part of the blow box at which the supply air is fed thereinto. The control means 20,20' preferably extend into the blow box through a distance corresponding to approximately one tenth of the total longitudinal extension of the blow box.

Similarly to the lower blow box, the means fitted to the upper blow box also constitutes a device for changing the direction of air flow therein. The device has the form of a plate or disc 21' provided with a number of slots 22', each slot comprising a first edge portion which faces in the direction of air flow and a second edge portion 22*b'* which extends into the air flow. The device is arranged to deflect the air flow in the end-part of the upper blow box in relation to a centre line on the web material through an angle smaller than 25°, preferably about 10°. The directions of sequential air flows, or air streams, are arranged to gradually decrease.

Figure 8:
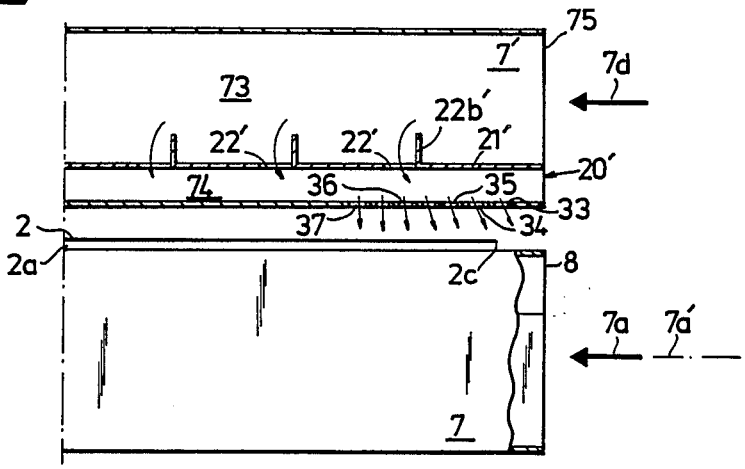
FIG. 8 is a sectional side view of a means according to the invention inserted in the upper blow box according to FIG. 3, this figure illustrating more clearly the flow of incoming supply air and the distribution of said air in the end-part of the blow box.

It will be seen from FIG. 8 that the width of a dried paper web 2 decreases and that the air streams, via the aperture 33, located externally of the edge portion 2*c* of the paper web 2 tend to smooth-out said edge portion instead of lifting the same, as with prior art techniques.

It will be understood that the invention is not limited to the aforedescribed embodiment, and that modifications can be made within the scope of the following claims.

We claim:

1. An arrangement in material drying sections of the kind in which the material, in the form of a web, is arranged for movement through the drying section while being supported by a plurality of air streams which impinge on an undersurface of the web and extend parallel, or substantially parallel with a plane of said web, each of said air streams being directed through a plurality of nozzle-like exit orifices formed in a blow box and providing the air streams with an exiting velocity and direction so as to hold the web material in a suspended position, said blow box having an end portion which receives a flow of supply air, the end portion provided with means for reducing and/or eliminating and/or over-compensating a velocity vector influence of the flow of supply air on the air streams as the air streams exit the nozzle-like orifices, the blow box having an interior divided into two chambers, a first chamber for receiving substantially all of the incoming air flow and a second chamber for receiving a portion of the air flow, said portion of the air flow having a velocity vector less than the velocity vector of the incoming air flow entering the first chamber, the nozzle-like exit orifices being positioned downstream from said second chamber, said means for reducing and/or eliminating and/or over-compensating the velocity vector influence being a plate or disc provided with a number of slots and being of an elongated configuration with a length shorter than half the longitudinal extension of the blow box and preferably shorter than one quarter of said longitudinal extension.

2. An arrangement according to claim 1, wherein a group of blow boxes are provided with said means for reducing and/or eliminating and/or over-compensating said velocity vector influence.

3. An arrangement according to claim 2, wherein additional blow boxes provided with said nozzle-like exit orifices facing the material web are arranged above said web.

4. An arrangement according to claim 1, wherein the blow box is provided with a planar and/or substantially planar upper surface extending parallel with the material web, said plurality of nozzle-like orifices provided in said surface; said means for reducing and/or eliminating and/or over-compensating said velocity vector influence arranged for co-action solely with a number of said nozzle-like exit orifices located adjacent said end-part of the blow box.

5. An arrangement according to claim 4, wherein the nozzle-like orifices are located at a predetermined distance from the edge part of the upper surface of the blow box.

6. An arrangement according to claim 4, wherein the nozzle-like orifices alternate facing in a downstream direction of web travel while other nozzle-like orifices alternate facing in a upstream direction so as to produce an air stream directed against the direction of web travel.

7. An arrangement according to claim 6, wherein the nozzle-like orifices are arranged along and on or adjacent to a center line of a planar upper surface of the blow box.

8. An arrangement according to claim 7, wherein the nozzle-like orifices have a form which conforms to part of a circle, preferably a segment of a circle, suitably smaller than a semi-circle.

9. An arrangement according to claim 6, wherein the nozzle-like orifices have a form which conforms to part of a circle, preferably a segment of a circle, suitably smaller than a semi-circle.

10. An arrangement according to claim 9, wherein a depression is located in said upper surface adjacent respective nozzle-like orifices, the depression having a depth which decreases in a direction away from an associated orifice.

11. An arrangement according to claim 1, wherein two or more mutually adjacent blow boxes are supplied with air through similarly located end portions.

12. An arrangement according to claim 1, wherein additional blow boxes provided with said nozzle-like exit orifices facing the material web are arranged above said web.

13. An arrangement according to claim 12, wherein said means for controlling and guiding the air streams is arranged in the end portion of one or more upper blow boxes in a manner such that each said air stream is imported a well-defined direction at right angles to, or substantially at right angles to said web material, or also in a direction slightly towards said end part.

14. An arrangement according to claim 12, wherein said means operative in reducing and/or eliminating and/or over-compensating the influence of the velocity vector of the incoming air flow on the direction of the air streams exiting form the blow box through the nozzle-like orifices located adjacent said end portion of said blow box is provided in the end portion of the blow box.

15. An arrangement according to claim 14, wherein all said upper blow boxes forming a group of such boxes are provided with means for reducing and/or eliminating and/or over-compensating said velocity vector influence.

16. An arrangement according to claim 12, wherein the upper blow box has a planar undersurface extending parallel with the material web, a plurality of nozzle-like exit orifices provided therein; said means for reducing and/or eliminating and/or over-compensating said velocity vector influence serves solely a number of said nozzle-like orifices located adjacent said end portion of the blow box.

17. An arrangement according to claim 12, wherein two or more mutually adjacent upper blow boxes provided with nozzle-like orifices through which air streams exit from the box are supplied with air through similarly located end portions of respective boxes.

18. An arrangement according to claim 12, wherein said means comprises a device for changing direction of air flow in the blow box.

19. An arrangement according to claim 12, wherein the means is of elongated configuration and has said one end portion thereof located in or adjacent the end portion of the blow box at which supply air is introduced thereinto; said means extends into the blow box through a distance corresponding approximately to one tenth of the total longitudinal extension of the blow box.

20. An arrangement according to claim 1, wherein said means is arranged to direct the air flow in the end portion of the blow box outwardly in relation to a center line of the web through an angle smaller than 25°, preferably about 10°.

21. An arrangement according to claim 1, wherein the means is of elongated configuration and has end portions thereof located in or adjacent the end portion of the blow box at which supply air is introduced thereinto; said means extends into the blow box through a distance corresponding approximately to one tenth of the total longitudinal extension of the blow box.

22. An arrangement according to claim 1, wherein the means is of elongated configuration and has one said end portion thereof located in or adjacent the end portion of the blow box at which supply air is introduced thereinto; said means extends into the blow box through a distance corresponding approximately to one tenth of the total longitudinal extension of the blow box.

23. An arrangement according to claim 1, wherein each of said plurality of slots has a first edge portion facing said incoming air flow and a second edge portion which extends into said incoming air flow, the second edge portion adjacent the first edge portion.

24. An arrangement according to claim 1, wherein an acute angle is defined between said flow of supply air and the part of said flow of supply air passing through said nozzle-like orifices.

25. An arrangement in material drying sections of the kind in which the material, in the form of a web, is arranged for movement through the drying section while being supported by a plurality of air streams which impinge on an undersurface of the web and extend parallel, or substantially parallel with a plane of said web, each of said air streams being directed through a plurality of nozzle-like orifices formed in a flow box and providing the air streams with an exiting velocity and direction so as to hold the web material in a suspended position, wherein said blow box has an end portion which receives a flow of supply air, the end portion provided with means for reducing and/or eliminating and/or over-compensating a velocity vector influence of the flow of supply air on the air streams as the air streams exit the nozzle-like orifices, said means being a plate of disc provided with a plurality of slots, a part of said flow of supply air being directed substantially perpendicular to said flow of supply air through said plurality of slots and continues in the perpendicular direction so as to pass through said nozzle-like orifices, each of said plurality of slots having a first edge portion facing said incoming air flow and a second edge portion which extends into said incoming air flow, the second edge portion being adjacent the first edge portion.

26. An arrangement according to claim 25, wherein an interior portion of the upper blow box is divided into two chambers, a first chamber for receiving the flow of incoming supply air, and a second chamber for receiving said portion of the air flow, said portion of the air flow having a velocity vector which is less than a velocity vector of the incoming air flow in the first chamber, and preferably counter-directed thereto.

27. An arrangement according to claim 26, wherein the nozzle-like orifices in the upper blow box are in direct communication with the second chamber.

28. An arrangement according to claim 27, wherein the upper blow box has a planar under-surface extending parallel with the material web, a plurality of nozzle-like exit orifices provided therein; said means for reducing and/or eliminating and/or over-compensating said velocity vector influence serves solely a number of said nozzle-like orifices located adjacent said end portion of the blow box.

29. An arrangement according to claim 25, wherein an acute angle is defined between said flow of supply air and the part of said flow of supply air passing through said nozzle-like orifices.

30. An arrangement in material drying sections of the kind in which the material, in the form of a web, is arranged for movement through the drying section while being supported by a plurality of air streams which impinge on an undersurface of the web and extend parallel, or substantially parallel with a plane of said web, each of said air streams being directed through a plurality of nozzle-like exit orifices formed in a plurality of blow boxes and providing the air streams with an exiting velocity and direction so as to hold the material web in a suspended position with said nozzle-like exit orifices facing the material web and being arranged above said web, said plurality of blow boxes having an end portion which receives a flow of supply air, the end portion provided with means for reducing and/or eliminating and/or over-compensating a velocity vector influence on the flow of supply air on the air streams as the air streams exit the nozzle-like orifices, the plurality of blow boxes having an interior divided into two chambers, a first chamber for receiving substantially all of the incoming air flow and a second chamber for receiving a portion of the air flow, said portion of the air flow having a velocity vector less than the velocity vector of the incoming air flow entering the first chamber, the nozzle-like exit orifices being positioned downstream from said second chamber, said means for reducing and/or eliminating and/or over-compensating the velocity vector influence being a plate or disc provided with a number of slots.

31. An arrangement in material drying sections of the kind in which the material, in the form of a web, is arranged for movement through the drying section while being supported by a plurality of air streams which impinge on an undersurface of the web and extend parallel, or substantially parallel with a plane of said web, each of said air streams being directed through a plurality of nozzle-like exit orifices formed in a plurality of blow boxes being provided with a planar and/or substantially planar upper surface extending parallel with the material web, said plurality of nozzle-like orifices provided in said surface, the nozzle-like exit orifices providing the air streams with an exiting velocity and direction so as to hold the material web in a suspended position, said plurality of blow boxes having an end portion which receives a flow of supply air, the end portion provided with means for reducing and/or eliminating and/or over-compensating a velocity vector influence of the flow of supply air on the air streams as the air streams exit the nozzle-like orifices, the blow box having an interior divided into two chambers, a first chamber for receiving substantially all of the incoming air flow and a second chamber for receiving a portion of the air flow, said portion of the air flow having a velocity vector less than the velocity vector of the incoming air flow entering the first chamber, the nozzle-like exit orifices being positioned downstream from said second chamber, said means for reducing and/or eliminating and/or over-compensating the velocity vector influence being a plate or disc provided with a number of slots and being arranged to direct the air flow in the end portion of the blow box outwardly in relation to a center line of the web through an angle smaller than 2 degrees and preferably about 10 degrees.

* * * * *